US010502524B1

(12) United States Patent
Gee

(10) Patent No.: US 10,502,524 B1
(45) Date of Patent: Dec. 10, 2019

(54) SHOOTING OR RANGE BAG AS PART OF AN ORGANIZER KIT

(71) Applicant: Patrick Gee, Chino Hills, CA (US)

(72) Inventor: Patrick Gee, Chino Hills, CA (US)

( * ) Notice: Subject to any disclaimer, the term of this patent is extended or adjusted under 35 U.S.C. 154(b) by 0 days.

(21) Appl. No.: 13/891,078

(22) Filed: May 9, 2013

(51) Int. Cl.
*B65D 69/00* (2006.01)
*B65D 71/00* (2006.01)
*F41C 33/06* (2006.01)

(52) U.S. Cl.
CPC ..... *F41C 33/06* (2013.01)

(58) Field of Classification Search
CPC ..... F41C 33/06; B65D 69/00; B65D 71/00; A45C 1/08; F45B 39/00; F45B 39/02
USPC ..... 206/579, 223, 234, 349, 461, 466, 470, 206/471, 3, 578, 576; 383/38–40; 150/113; 224/911, 912, 931
See application file for complete search history.

(56) References Cited

U.S. PATENT DOCUMENTS

| | | | | | |
|---|---|---|---|---|---|
| 1,219,881 | A | | 3/1917 | Sundback | |
| 2,115,993 | A | | 4/1932 | Kranhold | |
| 3,624,686 | A | * | 11/1971 | Beals | 434/98 |
| 4,859,084 | A | * | 8/1989 | Kaumeyer | 383/39 |
| 5,294,031 | A | | 3/1994 | Volpei et al. | |
| 5,375,440 | A | | 12/1994 | Patterson | |
| 5,465,425 | A | * | 11/1995 | Crispin | 2/102 |
| 5,505,355 | A | | 4/1996 | Williams | |
| 5,584,424 | A | | 12/1996 | Stava | |
| 5,662,219 | A | | 9/1997 | Tschudy et al. | |
| 5,924,565 | A | | 7/1999 | Colee | |
| 5,996,865 | A | | 12/1999 | Bissey | |
| D448,561 | S | | 10/2001 | Kolpin | |
| 6,571,998 | B2 | * | 6/2003 | Godshaw et al. | 224/607 |
| 8,181,775 | B2 | * | 5/2012 | Bunn | 206/315.1 |
| 8,272,507 | B1 | * | 9/2012 | Crump et al. | 206/223 |
| D807,433 | S | | 1/2018 | Gee | |
| 2005/0045510 | A1 | | 3/2005 | Marks | |
| 2010/0083416 | A1 | * | 4/2010 | Curry | 2/51 |
| 2010/0235966 | A1 | * | 9/2010 | DeHart | 2/252 |
| 2011/0110611 | A1 | * | 5/2011 | Apple | A45C 13/02 383/40 |

OTHER PUBLICATIONS

G-Outdoors, Inc.; 2011 Wild About Shooting catalog; 2011, 4 pages.
G-Outdoors, Inc.; 2013 catalog; 2013, 48 pages.

* cited by examiner

*Primary Examiner* — Rafael A Ortiz
(74) *Attorney, Agent, or Firm* — Alford Law Group, Inc.; William E. Alford; David T. Bracken

(57) ABSTRACT

The present invention is an assembled kit for organization of a shooting or range bag comprising a central designation tablet of removable item designators with a modified shooting or range bag. The designation tablet is preferably a flexible card having a securing surface on its two sides and a securing means by which it releasably attaches to an inside or outside surface of the shooting or range bag. The designation tablet preferably comprises two mateable hook and loop surfaces upon which small removable item designators are located until a user desires to remove one or more for application to secure to an outside surface of a closing flap of a soft-sided pocket.

17 Claims, 4 Drawing Sheets

SHOOTING OR RANGE BAG AS PART OF AN ORGANIZER KIT

FIELD OF THE INVENTION

The present invention relates to multi-pocketed bags for carrying of guns and shooting accessories, especially in the context of a kit integral for organizing the shooting accessories.

BACKGROUND OF THE INVENTION

Rifles, shotguns, and other firearms are regularly operated by their users for purposes other than sport and hunting. It is perhaps true that most firearm discharges are for shooting at targets for enjoyment and improving a user's accuracy and speed. In contrast to hunting where relatively few shots are taken, a shooter taking advantage of range shooting typically intends to fire as much as the shooter's budget for money and time will allow. Thus, the range shooter is in a unique circumstance as compared with a hunting shooter. The range shooter is subject to range rules and regulations, which may include wearing of safety equipment. The range shooter must carry fairly heavy ammunition supplies to the shooter's station and maintain them in a safe manner. The range shooter is in what is generally found to be an atmosphere where the focus on safety and intense attention to verbal and visual cues about when shooting may start and stop, as well as when a shooter may retrieve or replace a paper target.

The range shooter is also typically also exposed to the inspection of other shooters and range personnel so that that conformity with range rules, especially about safety and awareness of ones surroundings, and personal shooting activities can be easily corrected. Thus, many features and situations all around the shooter must receive careful attention, both visual and audible.

Clearly, the range shooter is benefited by minimizing distractions by way of organization of the shooter's supplies. As opposed to the hunting shooter, the range shooter requires a sturdy shooting or range bag at least for carrying ammunition and small firearms, such as pistols. In addition, a range shooter will almost certainly carry in the shooting or range bag a relatively standard set of items in support of the range shooter's activities. While theses support items are fairly standard, their organization in the shooting or range bag has been entirely disregarded to the prejudice of the range shooter.

One drawback to a failure to provide for organization of relatively standardized shooter supplies at a shooting range or other target shooting venue is that significant diversion of the range shooter's attention from the firearm, the shooter's surroundings and situation, and the target generally requires the shooter to properly secure their firearm, either by laying the firearm down in a proper manner, engaging the safety, and/or unloading the firearm entirely. Thus, the disorganized shooting or range bag is a potentially dangerous distraction, inducing the range shooter to, in some circumstances, rummage about in the shooting or range bag without taking proper care of the firearm or paying attention to visual or audible instructions about range activities. For instance, a range shooter rummaging about in a shooting or range bag for their shooting glasses may miss the instruction to begin firing, which will preclude that shooter from taking part in that shooting session. It may induce that shooter to fumble to put on their late-found shooting glasses and begin shooting at a time which is against the rules or in an unsafe manner.

Where in other situations as poorly organized supplies bag may only be inconvenient, the prior art of shooting and range bags has been to proliferate a potentially dangerous situation without addressing the problem. In contrast to the prior art, the present invention provides the range shooter with an effective solution to the inconvenience and potential danger of a disorganized shooting or range bag.

SUMMARY OF THE INVENTION

The present invention is a multi-pocketed shooting or range bag which is integrally packaged and sold as part of an organizer kit. The multi-pocketed shooting or range bag typically comprises a soft or rigid walled bag with a carrying handle, where several soft-sided pockets are fixed to vertical soft or rigid walls and have top openings which are secured by a soft flap connected to a front surface of the soft-sided pocket by a snap, clasp or hook and loop connector. The soft flap is easily opened by lifting up on a lower edge to expose the contents of the soft-sided pocket. In a typical shooting or range bag, the vertical inside and outside surfaces are so covered with separate soft-sided pockets that the actual inside or outside surface is sometimes covered thereby. This is because the range shooter, while carrying a relatively standard set of shooting supplies, requires that such supplies be kept separate to provide a minimal level of organization. In contrast to the prior art, where the range shooter was required, without great success, to remember the contents of each of the unmarked soft-sided pockets, the present invention provides the range shooter with replaceable organizer designations for the exterior surface for each soft flap of each soft-sided pocket identifying the category of standard items which are contained in that soft-sided pocket.

Most notable in the present invention assembly for organization of a shooting or range bag is a central designation tablet of removable item designators. The designation tablet is preferably a flexible card having a securing surface on its two sides and a securing means by which it releasably attaches to an inside or outside surface of the shooting or range bag. The designation tablet preferably comprises two mateable hook and loop surfaces upon which small removable item designators are located until a user desires to remove one or more for application to secure to an outside surface of a closing flap of a soft-sided pocket. Where other organizer concepts using removable item indicators may have been proposed in the prior art, the present invention intends that the designation tablet be instantly available in a location chosen by a user. The designation tablet may be connected by way of knotted or latchable lanyard, small cord, a thin chain or the like to engage a handle, loops of fabric or rigid rings fixed to an inside surface or outside surface of the shooting or range bag, which loops of fabric and rings are well known in the art for releaseably attaching objects to a bag.

It is an object of the invention to provide a user a shooting or range bag offering flexibility and storage design and allows the user to customize organization choices to meet his or her specific shooting needs. Essentially all shooting ranges require eye protection in the form of shooting glasses and ear protection in the forms of ear plugs or ear muffs. A user of the invention shooting or range bag will enjoy the options of appropriately identifying a location for their large, wrap-around shooting glasses in one of the largest and loosest of pockets or in a smaller pocket for a smaller set of shooting glasses, thereby reserving the largest and loosest pocket for other items. Further, a user of the invention shooting or range bag will enjoy the options of ear protection of appropriately identifying a location for their larger ear muffs (whose structure can interfere with resting the user's face against the stock and are not desirable for that use) in one of the largest and loosest of pockets or for their moldable ear plugs (which are desirable for long gun shooting) in a relatively small pocket. A further customization of a shooting or range bag will be in the items used for securing targets to their supports, where user's, in general order of preference, will choose to store in the appropriately designated pocket a stapler, tape or tacks.

Because the present invention will use item designators adapted to be releaseably fixed to an exterior soft-sided pocket on a shooting or range bag as well as on such pockets on an interior pocket of that bag, the specifics of construction and fixation of the item designators are a critical feature of the present invention. It is well known that the exterior surfaces of shooting or range bags experience very substantial abrasion, pokes, and shocks in the course of transportation, user searching of pockets, and placement of such bags for storage among other bags or large items. Prior art item designators which have been removable have been found not capable of remaining affixed to an exterior surface of the shooting or range bag, where such bags may often be carried through brush and tree branches and/or exposed to rain, snow, and extremely cold or hot temperatures. Further, prior art item designators have not been found to possess the feature of being washable, as are the present invention item designators.

The item designators of the present invention are small rectangles or other entirely convex-edged pieces of flexible polymer fabric woven, embroidered, or molded with a flexible polymer to form a shooter's item symbol, which polymer fabric is sewn and/or bonded to a back side of a small corresponding shaped piece of hook and loop material, which allows for affixing it to the designation tablet or to a closing flap of a soft-side pocket. It has been found critical to the operation of the invention as used in its user environment to limit the longest edge to edge dimension of the polymer fabric to between 0.5 to 1.5 inches, and more preferably to between 0.75 to 1.25 inches. The lower dimension limit is required so that shooter's item symbols are instantly appreciated when viewed from a distance of about 4-5 feet. It has been found that the upper dimension limit prevents the item designator from being ripped from an external surface of a soft closing flap under the most vigorous of conditions. It is preferred that shooter's item symbols be embroidered or woven with a light colored thread on a dark colored flexible polymer fabric. Alternately, the shooter's item symbols are impressed by molding a flexible light colored polymer (such as an elastomer) to said dark fabric.

Further, the designation tablet is preferably 10 percent or greater in cumulative surface area on front and back surfaces than cumulative surface areas of all of the item designators included in an organizer kit of the present invention. It is intended that a user will not desire to carefully re-align item designators upon a surface of the designation tablet as they are provided in a new condition, but will instead desire to quickly and easily simply move item designators to closing flaps from the designation tablet and back again as a user's storage needs for a particular soft-sided pocket change. If such exchange is not easily made, a user will be less likely to keep their item designator changes current with their usage of a soft-sided pocket of their shooting or range bag. It is an object of the invention that the vertical walls of the invention shooting or range bag may be rigid while the pockets are formed of flexible material.

Because shooting and range bags can become quickly disorganized with several items thrown into a central interior storage space, a preferred embodiment of the item designators will be to require that a hook portion of hook and loop connector be used in the item designators. Such a requirement will allow for the item designators removed from a designation tablet or a closing flap and placed in said central interior storage space to easily affix to fabric items or interior surfaces of the shooting or range bag by way of the mass of polymer hooks on the item designators, preventing their inadvertent loss from the central interior storage space.

DETAILED DESCRIPTION OF THE INVENTION

The invention is now discussed with reference to the figures.

Figure 1:
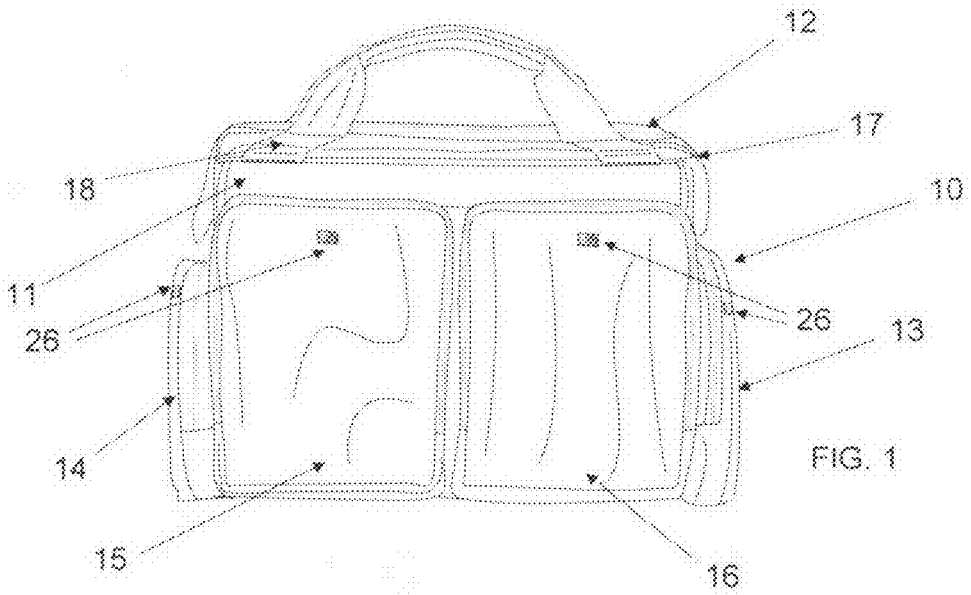
FIG. 1 is front view of a soft sided shooting or range bag according to the invention, showing hook and loop sites on soft-sided external pockets for affixing item designators.

FIG. 1 shows a representative soft-sided shooting or range bag 10 according to an embodiment having an external surface 11 and a top surface 12, and a handle 18. The shooting or range bag 10 includes a zippered opening (zippered closure) with a zipper 17 so that a user can access a central interior storage space having vertical long walls, vertical end walls, and a bottom. The soft-sided shooting or range bag 10 can include on inside surfaces, multiple adjacent soft-sided pockets with flexible closing flaps. Upon external surfaces of said end walls are located external end pockets 13 and 14. Upon external surfaces of said long walls are located two external pockets 15 and 16. One or more of the external pockets 13 though 16 can have permanently affixed hook and loop sites (releasable attachment sites) 26 upon which releasable item designators (see releasable item designators 20 shown in FIG. 2) can be affixed or removed.

Figure 2:
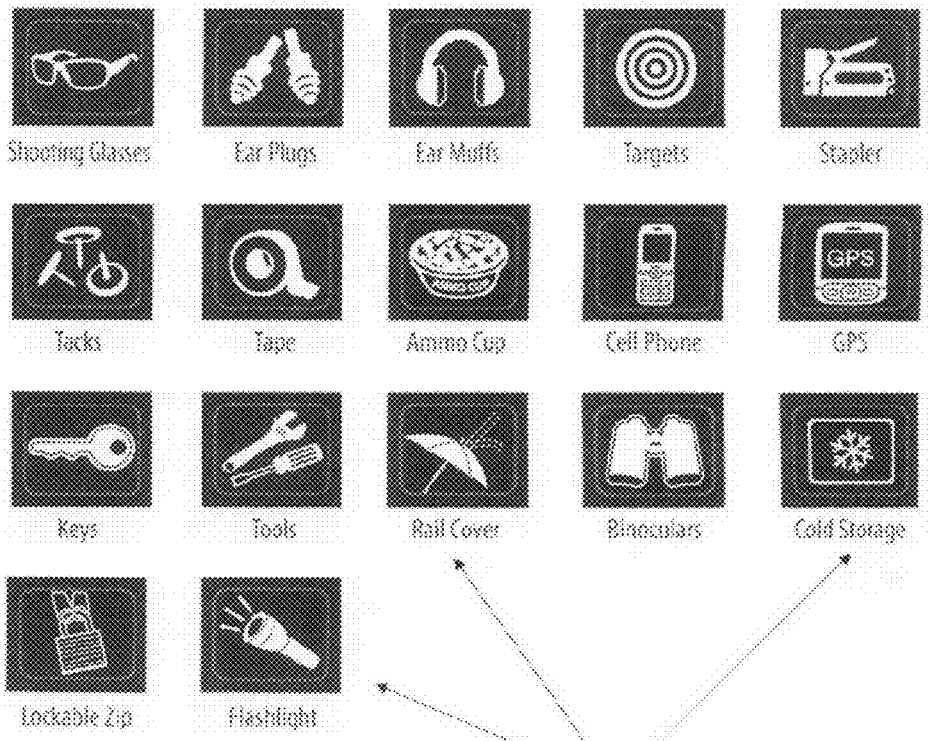
FIG. 2 is a front view of an expanded set of item designators, selectable for a particular type of shooting or range bag.

FIG. 2 illustrates a standard expanded set of releasable item designators 20. On a front side, each releasable item designator 20 has a highly identifiable shooter's item symbol embroidered upon the front side of a small piece of flexible polymer fabric. On a back side, each releasable item designator 20 has a hook and loop back (releasable attachment surface) permanently connected to a back side of the flexible polymer fabric to releasably affix an item designator to releasable attachment surfaces of a designator tablet (e.g., see FIGS. 6-7) or releasable attachment sites of pockets (e.g., see FIGS. 1, 3, 5). Individual shooter's item symbols shown are for shooting glasses, ear plugs, ear muffs (for noise suppression), targets, stapler, tacks, tape, ammunition cup, cellular phone, GPS device, keys (such as car keys or storage locker keys), tools (such as small tools used to work on firearms, scopes, or range devices), a rain cover (such as for the shooting or range bag itself or a poncho for a user), binoculars, cold storage (such as an insulated pocket with ice or equivalent for keeping food items cold), a lock for locking the shooting or range bag, flashlight, and (shown in FIG. 6) camera. Selections of these 18 shooter's items for a shooting or range bag can vary. Accordingly, the number of releasable item designators provided in a kit for sale to a user can also vary.

Figure 3:
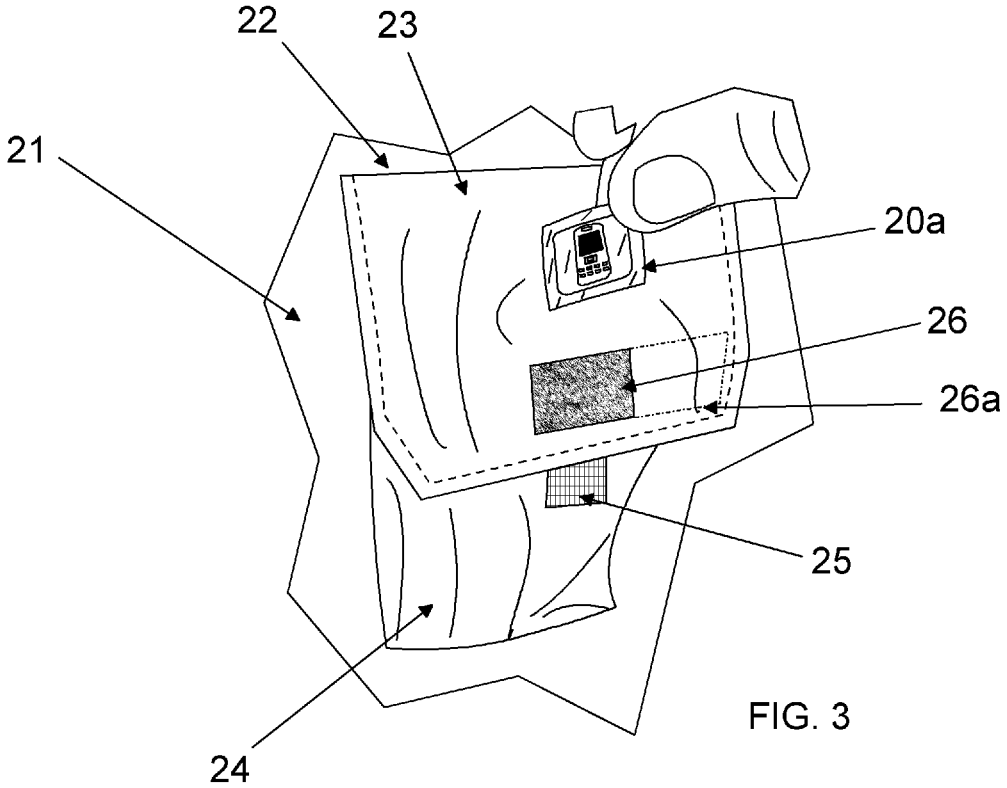
FIG. 3 is a front view a soft-sided pocket according to the invention having a closing flap bearing a hook and loop site and an expansion hook and loop site in broken lines.

FIG. 3 shows a representative soft-sided pocket 24 permanently affixed to a vertical internal or external wall 21 of a shooting or range bag, with a flexible closing flap 23 connected to wall 21 at connection 22. As its name implies, the flexible closing flap 23 closes over an opening into the soft-sided pocket 24 to retain items therein. Upon an outside surface of flap 23 is permanently affixed a hook and loop site 26 (which may be expanded to expansion site 26*a* to allow affixing of more than one releasable item designator 20 as in FIG. 1 in adjacent orientation). A user's thumb and forefinger are shown grasping a corner of a releasable item designator 20*a* in a position from which the user may releaseably affix the releasable item designator 20*a* to site 26 or to remove the releasable item designator from site 26 to indicate the current or desired contents of pocket 24. The flexible closing flap 23 can include an opening tab 25 as shown in FIG. 3 to hold a position of the closing flap when applying or removing the releasable item designator 20. A user affixing a releasable item designator 20 to site 26 can thereafter appreciate the contents of pocket 24.

Figure 4:
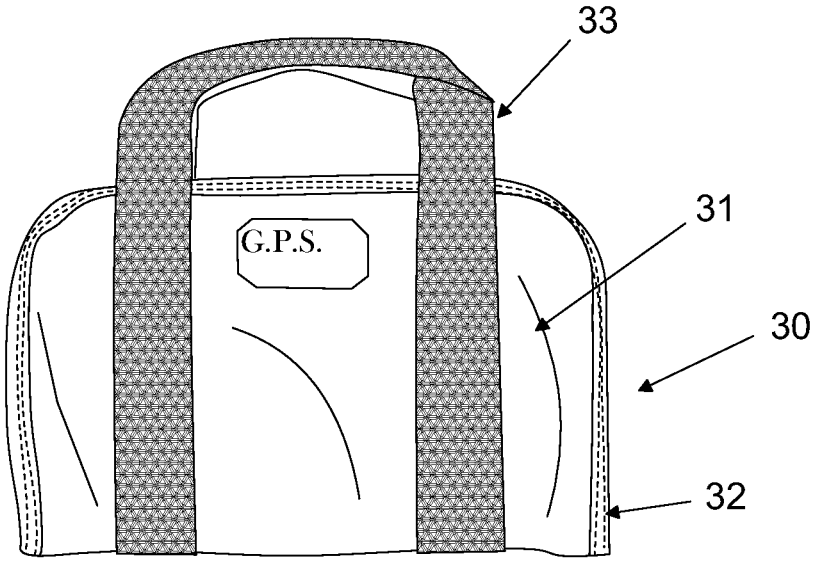
FIG. 4 is front view of a closed specific type of shooting or range bag.
Figure 5:
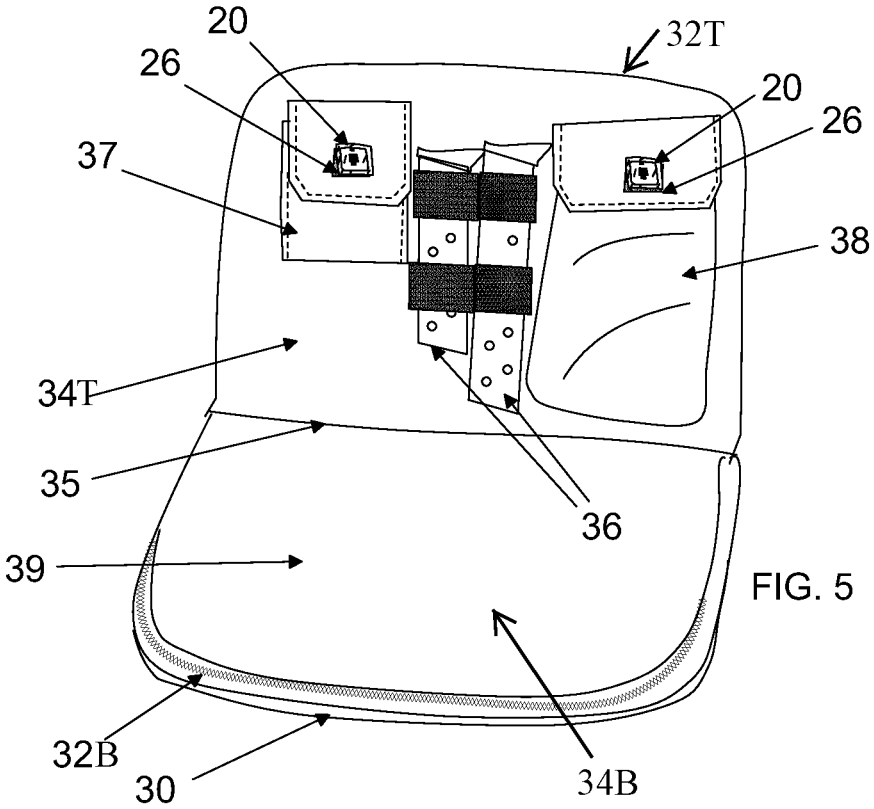
FIG. 5 is an open view of the specific type of shooting or range bag of FIG. 4, exposing a limited set of soft-sided pockets and a central interior storage space.

FIG. 4 shows a representation of a single pistol shooting bag 30 according to one embodiment of the invention. The bag 30 includes a handle 33 supporting a small bag 31 that opens like a book into a top half 34T and a bottom half 34B along a fold portion 35 as shown in FIG. 5 when a zipper 32 of a zippered closure (zippered opening) is unzipped. The zipper 32 of the zippered closure unzips into its top zipper half 32T and its bottom zipper half 32B near the edges of the top half 34T and the bottom half 34B of bag 31, respectively. The zipper 32 of the zippered closure, when zipped up, holds the top half 34T and the bottom half 34B of bag 31 folded together along the fold portion 35 as shown in FIG. 4.

FIG. 5 shows a central interior storage space 39 of the bag 31 reserved primarily for a single handgun. Other items (e.g., gun clips 36, earplugs, glasses, lock) can generally be stored in the top half 34T of the bag 31 that opens along the fold portion 35 away from the bottom half 34B. Two soft-sided pockets 37 and 38 are mounted to an interior surface in the top half 34T of the bag 31 and have closing flaps as shown. Each of the closing flaps of the pockets 37,38 includes a hook and loop site (releasable attachment site) 26 to which an item designator 20 can releasably be affixed. For a pistol shooting bag, item designators 20 can be limited to a set of earplugs, glasses, ammunition bowl, and a lock.

The specific example of FIGS. 4 and 5 demonstrate that specific shooting and range bags are known in the art to consist of generally standard shooter's items that will be found in that specific shooting and range bag. Thus, the invention kit for that that shooting and range bag will limit the item designators 20 (as in FIG. 1) originally supplied with a designation tablet to only a few of those available from a supplier, such specific item designators 20*b* and 20*c* in FIG. 5. In the case of a general shooting or range bag as is shown in FIG. 1, the invention kit will be provided with a designation tablet with all the item designators available from a supplier.

Figure 6:
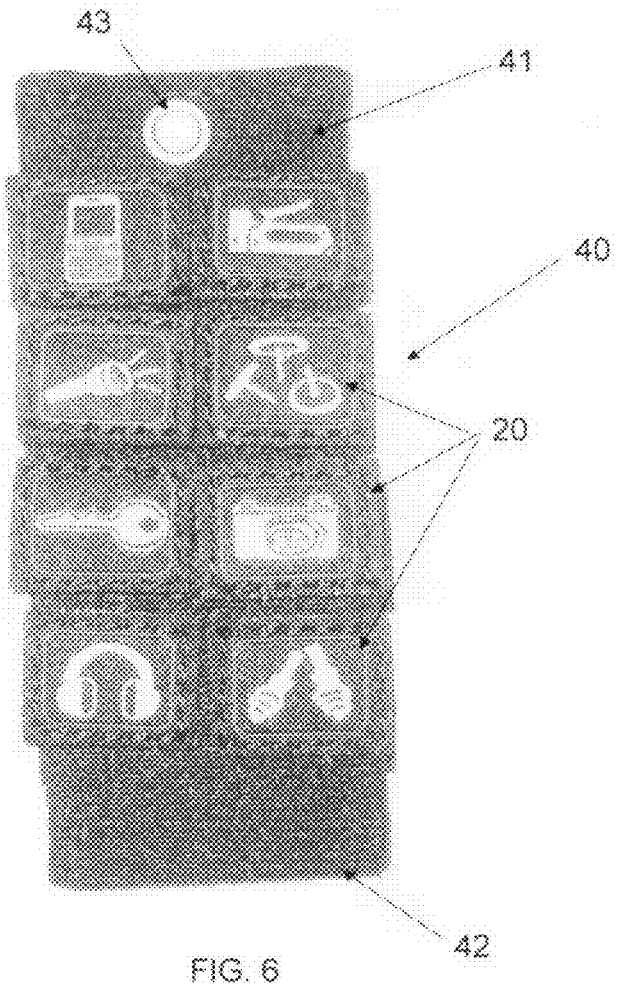
FIG. 6 is a front view of one form of a designation tablet of the invention.
Figure 7:
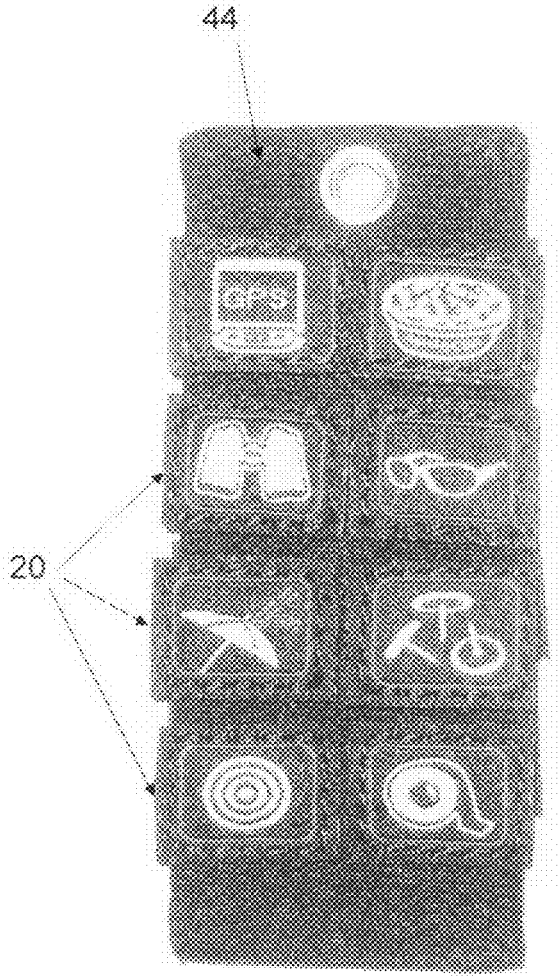
FIG. 7 is a rear view of the designation tablet of FIG. 6.

FIGS. 6 and 7 show a desired designation tablet 40 having a cord opening 43 and respectively a front side 41 and a rear side 44, each bearing releasable item designators 20 in such a wide range that they are incorporated into a kit including a general purpose shooting or range bag. The designation tablet 40 has releasable attachment surfaces (hook and loop surfaces) on the front side and the rear side to receive the releasable item designators 20.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A kit for storage and organizing shooting supplies, the kit comprising:

a shooting or range bag having a zipper forming a zippered closing into an interior space adapted to receive one or more handguns; and at least two or more separated pockets, each separated pocket adapted to contain and support at least one shooter's item, each separated pocket being mounted to internal walls of the interior space or external walls of the shooting or range bag, each separated pocket having a closing flap adapted to close over an opening into the separated pocket;

a designation tablet having releasable attachment surfaces on front and rear sides;

two or more releasable item designators releasably fixed to the designation tablet, wherein each releasable item designator is a small, convex-edged piece having an item symbol on a front side and a releasable attachment surface on a back side adapted to releasably affix the item designator to the releasable attachment surfaces of the front or back sides of the designation tablet; and wherein the shooting or range bag further has releasable attachment sites on two or more of the closing flaps adapted to receive the two or more releasable item designators such that two or more releasable item designators may be moved from the designation tablet to the releasable attachment sites on the two or more closing flaps of the at least two or more separated pockets.

2. The kit of claim 1 wherein the separated pockets are soft-sided pockets.

3. The kit of claim 2 wherein the closing flaps are flexible and include an opening tab for holding a position of the closing flap when applying or removing a releasable item designator.

4. The kit of claim 1 wherein the releasable attachment site of at least one separate pocket is an expanded releasable attachment site to allow more than one releasable item designator to be affixed to the closing flap in adjacent orientation.

5. The kit of claim 1 wherein the shooting or range bag comprises a bag adapted to transport a single handgun.

6. The kit of claim 1 wherein from two to eighteen releasable item designators are releasably fixed to the designation tablet.

7. The kit of claim 1 further comprising a lock for locking the shooting or range bag.

8. The kit of claim 1 wherein the designation tablet has a cord opening and the kit further comprises a lanyard to releasably couple together the designation tablet and the shooting or range bag.

9. The kit of claim 1 wherein the two or more releasable item designators bear shooter's item symbols chosen from a group consisting of shooting glasses, ear plugs, ear muffs, targets, stapler, tacks, tape, ammunition cup, cellular phone, GPS device, keys, tools, a rain cover, binoculars, cold storage, a lock, flashlight, and camera.

10. The kit of claim 1 wherein the two or more releasable item designators bear shooter's item symbols chosen from a group consisting of shooting glasses, ear plugs, ammunition cup, and a lock.

11. The kit of claim 1 wherein the two or more releasable item designators bear shooter's item symbols chosen from a group consisting of camera, ear muffs, ear plugs, keys, tacks, flashlight, stapler, and cellular phone.

12. The kit of claim 1 wherein the two or more releasable item designators bear shooter's item symbols chosen from a group consisting of GPS device, ammunition cup, binoculars, shooting glasses, a rain cover, tacks, targets, and tape.

13. The kit of claim 1 wherein the two or more releasable item designators are from 0.5 to 1.5 inches as measured at a longest edge to edge dimension.

14. The kit of claim 13 wherein the two or more releasable item designators are from 0.75 to 1.25 inches as measured at a longest edge to edge dimension.

15. The kit of claim 14 wherein a total surface area of the designation tablet is ten percent or greater than a cumulative front surface areas of all the releasable item designators in the kit.

16. The kit of claim 1 wherein the two or more releasable item designators releasably coupled to the releasable attachment sites on the two or more closing flaps of the at least two or more separated pockets can be released and moved back to the designation tablet.

17. The kit of claim 1 wherein the shooting or range bag further has a handle coupled to at least one of the external walls of the shooting or range bag.

* * * * *